US006326990B1

(12) United States Patent
Imai

(10) Patent No.: US 6,326,990 B1
(45) Date of Patent: Dec. 4, 2001

(54) THICK FILM THERMAL HEAD AND METHOD OF MANUFACTURING THE SAME

(75) Inventor: Ryoichi Imai, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/651,895

(22) Filed: Aug. 30, 2000

(30) Foreign Application Priority Data

Aug. 31, 1999 (JP) ..... 11-245841

(51) Int. Cl.[7] ..... B41J 2/335
(52) U.S. Cl. ..... 347/208; 347/200
(58) Field of Search ..... 347/200, 208; 29/611

(56) References Cited

U.S. PATENT DOCUMENTS 4,030,408 6/1977 Miwa .
4,559,542 * 12/1985 Mita ..... 347/208

FOREIGN PATENT DOCUMENTS 0 391 717 10/1990 (EP) .
60-198263 10/1985 (JP) .
63-122575 5/1988 (JP) .
63-165153 7/1988 (JP) .

OTHER PUBLICATIONS

European Search Report, Apr. 25, 2001, 3 pages.

* cited by examiner

*Primary Examiner*—Huan Tran
(74) *Attorney, Agent, or Firm*—Nixon Peabody LLP; Donald R. Studebaker

(57) ABSTRACT

A thick film thermal head includes a substrate which is provided with a groove on a surface to extend in a main scanning direction and has an electrically conductive portion which faces the groove and extends substantially over the entire length of the groove. A resistance heater strip is embedded in the groove to be in contact with the electrically conductive portion substantially over its entire length. A plurality of discrete electrodes are formed on the surface of the substrate and are in contact with the resistance heater strip at predetermined intervals in the main scanning direction. The discrete electrodes are electrically insulated from the electrically conductive portion of the substrate except through the resistance heater strip, and the electrically conductive portion is connected to a power source to be applied with an electrical potential and forms a common electrode. The discrete electrodes are connected to the power source through respective switching means to be selectively supplied with an electrical potential different from that applied to the electrically conductive portion.

14 Claims, 15 Drawing Sheets

THICK FILM THERMAL HEAD AND METHOD OF MANUFACTURING THE SAME

BACKGROUND OF THE INVENTION

1. Field of the Invention

This invention relates to a thick film thermal head and a method of manufacturing the same.

2. Description of the Related Art

As the thermal head used in various image forming apparatuses, there have been known a thin film thermal head and a thick film thermal head. The former is formed by the use of thin film forming technique and the latter is formed by the use of technique other than the thin film forming technique. When perforating a heat-sensitive stencil material to make a stencil for a stencil printer by the use of such a thermal head, it is required that adjacent perforations are clearly separated in order to obtain a high printing quality. Further, in order to make feasible stencil printing in a large size, e.g., A2 size or larger sizes, it is required to make a thermal head in a large size. Further, since the manufacturing process and the manufacturing cost of the thermal head occupy a large part of the manufacturing process and the manufacturing cost of the stencil making apparatus for a stencil printer, there has been a demand for a thermal head which can be easily manufactured at low cost.

Generally, the thin film thermal head is manufactured by a high-level process using semiconductor manufacturing technology and expensive apparatuses such as a sputtering apparatus or a vacuum deposition apparatus, and accordingly, the manufacturing process of the thin film thermal head is complicated and the manufacturing cost of the thin film thermal head is high though the pattern and the dimensions of the electrodes and the resistance heater elements can be finely controlled. Further, the length of the thin film thermal head which can be manufactured by the use of an existing apparatus is 8 to 12 inches at the longest. To the contrast, the thick film thermal head can be produced, for instance, by screen printing, and can be easily produced at low cost and can be easily produced in a large size. However, it is very difficult to accurately control the dimensions of the electrodes and the resistance heater elements (especially the dimension of the resistance heater elements in the direction of width of the thermal head) of the thick film thermal head. Thus the thin film thermal head is advantageous over the thick film thermal head in some points and the latter is advantageous over the former in other points.

The thick film thermal head has been generally used in a thermal recording system and a ribbon transfer printing system. The thick film thermal head generally comprises an electrical insulating substrate such as of ceramic, a plurality of stripe electrodes formed on the substrate and a linear resistance heater strip formed on the electrodes. In this thick film thermal head, the resistance heater strip extends across the electrodes and the parts of the resistance heater strip between the electrodes form resistance heater elements. That is, when power is supplied to the electrodes, the resistance heater strip generates heat at the parts between the electrodes. Since the heater strip is in contact with the electrodes at the lower surface thereof, heat is generated from the lower surface of each resistance heater element and propagates the resistance heater element to the upper surface thereof where the resistance heater element is brought into contact with a recording medium. In this thermal head, heat generated from the lower surface of each resistance heater element spreads in various directions while it propagates the resistance heater element to the upper surface thereof, and each pixel of the image formed by the thermal head becomes larger than the heater element, which results in pixels contiguous to each other. In the thermal recording system and the ribbon transfer printing system, this is advantageous in that pixels (dots) can be formed in a state where the pixels are continuous to an extent proper to obtain a high quality image.

However, when the thick film thermal head is used for making a stencil as it is, each of the perforations becomes too large and the perforations cannot be discrete since the heat generated from the lower surface of each of the resistance heater elements spreads over a wide area while the heat propagates to the upper surface of the heat element, and at the same time, it takes a long time for the temperature of the surface of each heater element to reach a perforating temperature, which results in poor response of the thermal head. When the perforations are not discrete and are connected to each other, an excessive amount of ink is transferred to the printing paper through the stencil, which results in offset and/or strike through. Further, in the case of a stencil printer, ink is apt to spread when transferred to the printing paper through the perforations of the stencil and is apt to form printing dots larger than the perforations of the stencil. Accordingly, the perforations of the stencil should be smaller by an amount corresponding to spread of the ink and should be discrete from each other. From this viewpoint, the aforesaid thermal head where heat is generated from the lower surface of the resistance heater elements is not suitable for making a stencil.

In a thick film thermal head having a linear array of resistance heater elements extending in a main scanning direction (in the direction of width of a stencil), though the size of the perforations in the main scanning direction can be reduced by narrowing the intervals at which the electrodes are arranged, it is difficult to reduce the size of the perforations in the sub-scanning direction (the direction in which the stencil is conveyed) due to difficulties in narrowing the width of the resistance heater strip(e.g., to not larger than 100 $\mu$m).

That is, conventionally, the thick film thermal head is formed by coating resistance heater paste 30 by silk screening on electrodes 50 formed on an electrical insulating substrate 100 as shown in FIG. 15. Though the resistance heater paste 30 forms a narrow protrusion as shown by chained line immediately after coating, it is flattened in the sub-scanning direction with lapse of time as indicated at 31. This phenomenon occurs because the resistance heater paste 30 is flowable and there is provided no member for limiting spread of the paste, and makes it difficult to form a narrow resistance heater.

Also in the thermal recording system and the ribbon transfer printing system, there has been a problem that it is very difficult to improve printing resolution due to difficulties in narrowing the width of the resistance heater strip (e.g., to not larger than 100 $\mu$m). Further, as the thermal head is repeatedly driven, heat generated from the resistance heater elements accumulates in the thermal head, which results in a problem that the thermal response of each heater element deteriorates or control of the temperature of each heater element becomes difficult. The delay from the time the heat is generated at the lower surface of the heater elements to the time the heat is transferred to the upper surface of the same further enhance deterioration of the thermal response of the heater elements.

From the viewpoint of making smaller the perforations formed in the stencil material and making higher the printing resolution, the thin film thermal head is advantageous over the thick filmthermal head. In the thin filmthermal head, the width and/or shape of the heater elements can be controlled much more finely than in the thick film thermal head due to the difference in manufacturing process. However, the thin film thermal head is disadvantageous in that it is expensive and is difficult to produce in a large size as described above. That is, since the thin film thermal head is manufactured by the use of semiconductor manufacturing apparatuses which are generally for making integral circuits and the like and are not able to produce a large size thermal head by one step. Accordingly, a large size thin film thermal head must be produced by incorporating a plurality of small thermal head segments, which gives rise to a problem that heat generation becomes unsatisfactory at junctions between the segments, which can result in white stripes on prints. Further, difference in heat generating characteristic between the small thermal head segments can result in fluctuation in the printing density and can adversely affect the image quality of the prints. Though these problems may be overcome by carefully joining the thermal head segments, this approach deteriorates the yield of the thermal head and further adds to the manufacturing cost of the thermal head.

Further, since the thin film thermal head is formed of thin films, the resistance heater elements are small in volume and heat capacity. Accordingly, in order to ensure an amount of heat sufficient to properly perforate the stencil material, an excessively large amount of power must be supplied to the resistance heater elements and accordingly the resistance heater elements are apt to be deteriorated or damaged. Therefore, use of the thin film thermal head in stencil making is limited. For example, the thin film thermal head can be only used for stencil materials comprising a heat-sensitive film whose thickness and melting point are in predetermined ranges. When the thin film thermal head is used for perforating a stencil material whose thickness and melting point are not in the predetermined ranges, the resistance heater elements must be driven under excessive load and the resistance heater elements are more apt to be deteriorated or damaged, which results in deterioration in reliability and/or durability of the thermal head.

The stencil material for stencil printing generally comprises a laminate of a support sheet such as Japanese paper or gauze and a heat-sensitive film, or a heat-sensitive film alone. The stencil material comprising a heat-sensitive film alone is advantageous in that ink transferred to the printing paper through the perforations in the stencil is not interfered with a support sheet and a clear printed image can be obtained.

However, without a support sheet, the stencil material is not sufficient in mechanical strength and apt to be stretched or deformed during conveyance or the like. Accordingly, in the stencil material without a support sheet, the heat-sensitive film must be larger in thickness than in the stencil material with a support sheet. However, it is very difficult to surely perforate such a thick heat-sensitive film with the thin film thermal head which is limited in heat capacity.

Though a ceramic substrate has been conventionally employed in both the thick film thermal head and the thin film thermal head, the ceramic substrate is disadvantageous in that it generally requires a complicated manufacturing process, it is high in material cost and manufacturing cost, and it is difficult to form a highly smooth large surface.

Further, in the conventional thick film thermal head, the resistance heater strip is in the form of a protrusion on a substrate. This is disadvantageous in that paper grounds or resin grounds is peeled off the stencil material by the protruding resistance heater strip when the stencil material is moved relative to the thermal head during stencil making. The paper grounds or the resin grounds adheres to the surface of the protruding resistance heater strip and adversely affects stencil making, e.g., prevents the resistance heater strip from being brought into a close contact with the stencil material and causes the resistance heater strip to fail in perforating the stencil material.

As can be understood from the description above, though the conventional thick film thermal head is advantageous in that it can be easily manufactured at low cost and can be manufactured in a large size, it is very difficult to more finely perforate the stencil material and to suppress formation of connected perforations, or to print on a heat-sensitive recording medium or a printing paper at higher resolution, and to improve response of each resistance heater element. Further, the conventional thick film thermal head is disadvantageous in that paper grounds or resin grounds is apt to be generated and adversely affects stencil making or printing.

SUMMARY OF THE INVENTION

In view of the foregoing observations and description, the primary object of the present invention is to provide a thick film thermal head which is free from the drawbacks described above.

Another object of the present invention is to provide a method of manufacturing such a thick film thermal head.

In accordance with a first aspect of the present invention, there is provided a thick film thermal head comprising

- a substrate which is provided with a groove on a surface thereof to extend in a main scanning direction and has an electrically conductive portion which faces the groove and extends substantially over the entire length of the groove,
- a resistance heater strip embedded in the groove to be in contact with the electrically conductive portion substantially over the entire length thereof, and
- a plurality of discrete electrodes which are formed on the surface of the substrate and are in contact with the resistance heater strip at predetermined intervals in the main scanning direction,
- wherein the discrete electrodes are electrically insulated from the electrically conductive portion of the substrate except through the resistance heater strip, and the electrically conductive portion is connected to a power source to be applied with an electrical potential and forms a common electrode with the discrete electrodes being connected to the power source through respective switching means to be selectively supplied with an electrical potential different from that applied to the electrically conductive portion.

In one embodiment, an electrical insulating layer is provided between the discrete electrodes and the substrate, the electrical insulating layer is provided with an opening in alignment with said groove in the substrate, and the discrete electrodes are in contact with the resistance heater strip through the opening in the insulating layer.

In this case, the opening in the insulating layer may be narrower than the groove in the substrate in width.

In another embodiment of the present invention, the substrate comprises an electrically conductive layer and an electrical insulating layer superposed on the electrically conductive layer, and the groove is formed through the electrical insulating layer up to the electrically conductive layer. In this case, the electrically conductive layer forms said common electrode.

In still another embodiment of the present invention, the substrate comprises a first electrical insulating layer, an electrically conductive layer and a cpond electrical insulating layer superposed one on another in this order, and the groove is formed through the second electrical insulating layer and the electrically conductive layer up to the first electrical insulating layer. In this case, the electrically conductive layer forms said common electrode.

It is preferred that the substrate be heat-conductive.

In still another embodiment of the present invention, a circuit pattern including the discrete electrodes is formed on the surface of the substrate electrically insulated from the electrically conductive portion of the substrate.

In accordance with a second aspect of the present invention there is provided a method of manufacturing a thick film thermal head in accordance with the first aspect comprising the steps forming a groove on a surface of an electrically conductive substrate to extend in a main scanning direction, embedding a resistance heater strip in the groove, forming an electrical insulating layer on the surface of the substrate with the resistance heater strip exposed through an opening, and forming a plurality of discrete electrodes on the electrical insulating layer to be in contact with the resistance heater strip in the groove through the opening in the electrical insulating layer at predetermined intervals in the main scanning direction.

The opening in the electrical insulating layer may be formed to be narrower than the groove in width.

The electrical insulating layer may be formed by bonding electrical insulating film on the surface of the substrate.

A circuit pattern including the discrete electrodes may be formed on the surface of the electrical insulating layer.

In accordance with a third aspect of the present invention there is provided a method of manufacturing a thick film thermal head in accordance with the first aspect comprising the steps forming an electrical insulating layer on an electrically conductive substrate, forming a groove through the electrical insulating layer to a predetermined depth in the substrate to extend in a main scanning direction, embedding a resistance heater strip in the groove, and forming a plurality of discrete electrodes on the electrical insulating layer to be in contact with the resistance heater strip in the groove at predetermined intervals in the main scanning direction.

The electrical insulating layer may be formed by bonding electrical insulating film on the surface of the substrate.

A circuit pattern including the discrete electrodes may be formed on the surface of the electrical insulating layer.

In the thick film thermal head in accordance with the present invention, since the resistance heater strip is embedded in the groove, the width of the resistance heater strip is limited to the width of the groove. Accordingly, when a stencil is made with the thermal head of the present invention, perforations can be small even in the sub-scanning direction and the quality of the stencil can be improved so that the printing dots can be sufficiently small in size and the printing quality is improved. Further, when the thick film thermal head of the present invention is employed in thermal recording or ribbon transfer printing, finer printing dots can be formed at a higher density.

Further, since the resistance heater strip which is much thicker than the electrodes is embedded in the groove and is not projected from the surface of the thermal head, the aforesaid phenomenon that paper grounds or resin grounds is peeled off the stencil material can be avoided.

Further, since thickness of the resistance heater strip can be freely set, the heat capacity required to each resistance heater element can be ensured by properly selecting the thickness of the resistance heater strip even if the width of the resistance heater strip is reduced. Accordingly, even a stencil material solely comprising thick heat-sensitive film can be surely perforated. Further since heat generated by each resistance heater element is transferred to the recording medium through the electrode, which is thinner and higher in heat conductivity than the resistance heater strip, the heat can be more quickly transferred to the recording medium and applied to the recording medium before spreading wide. Accordingly, the effective heat generating area can be confined small, and the perforations formed in the stencil material can be smaller and can be kept separated from each other, or finer printing dots can be formed at a higher density.

Thus in accordance with the present invention, even if the width of the resistance heater elements is made narrower than that in the thin film thermal head, a sufficient heat capacity of each resistance heater element can be obtained, which is impossible for the thin film thermal head to obtain due to limited thickness of the resistance heater elements.

Further in the case of the thick film thermal head of the present invention, since each resistance heater element is formed between each discrete electrode and the substrate (which functions as a common electrode), only one electrode has to be formed on the surface of the thermal head for each resistance heater element. Accordingly, the number of electrodes to be formed on the surface of the thermal head can be substantially reduced to half as compared with a conventional thick film thermal head. Further, in the conventional thick film thermal head, since two resistance heater elements on opposite sides of each discrete electrode are driven by an electric voltage applied to the discrete electrode, the electric voltage to be applied to each discrete electrode has to be of a complicated waveform.

To the contrast, in the thick film thermal head of the present invention, since the electric voltage applied to one discrete electrode exclusively drives one resistance heater element, the electric voltage applied to each discrete electrode may be simple in waveform. Further crosstalk between adjacent resistance heater elements can be prevented.

DESCRIPTION OF THE PREFERRED EMBODIMENT

First Embodiment

Figure 1:
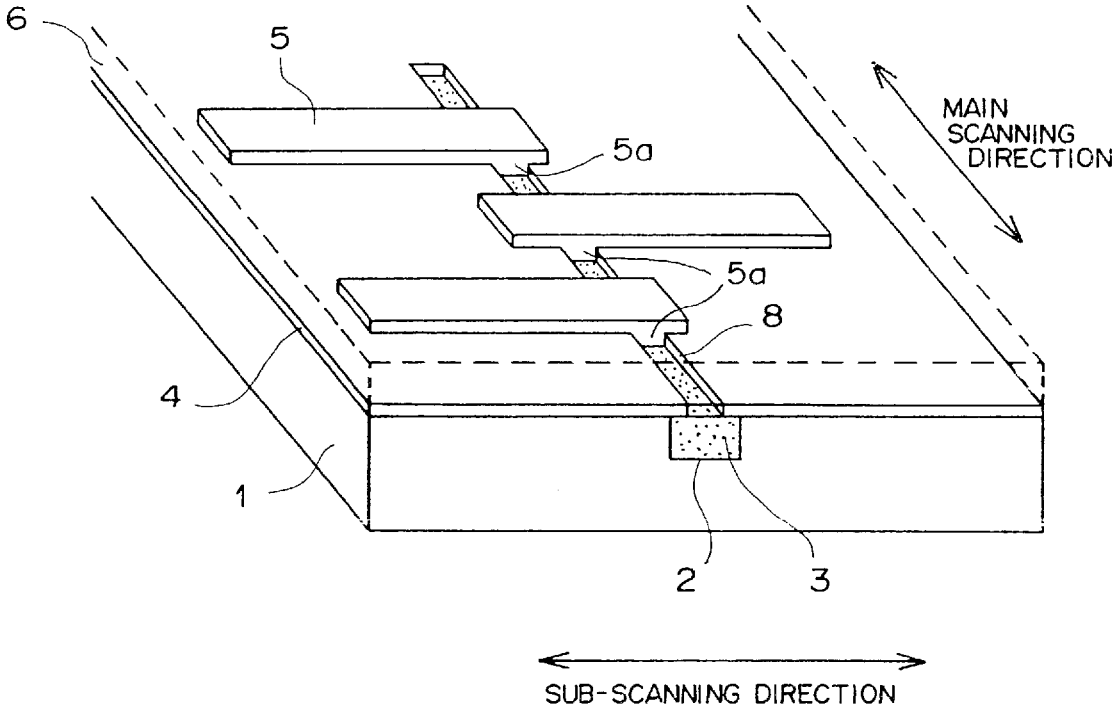
FIG. 1 is a fragmentary perspective view of a thick film thermal head in accordance with a first embodiment of the present invention.
Figure 2:
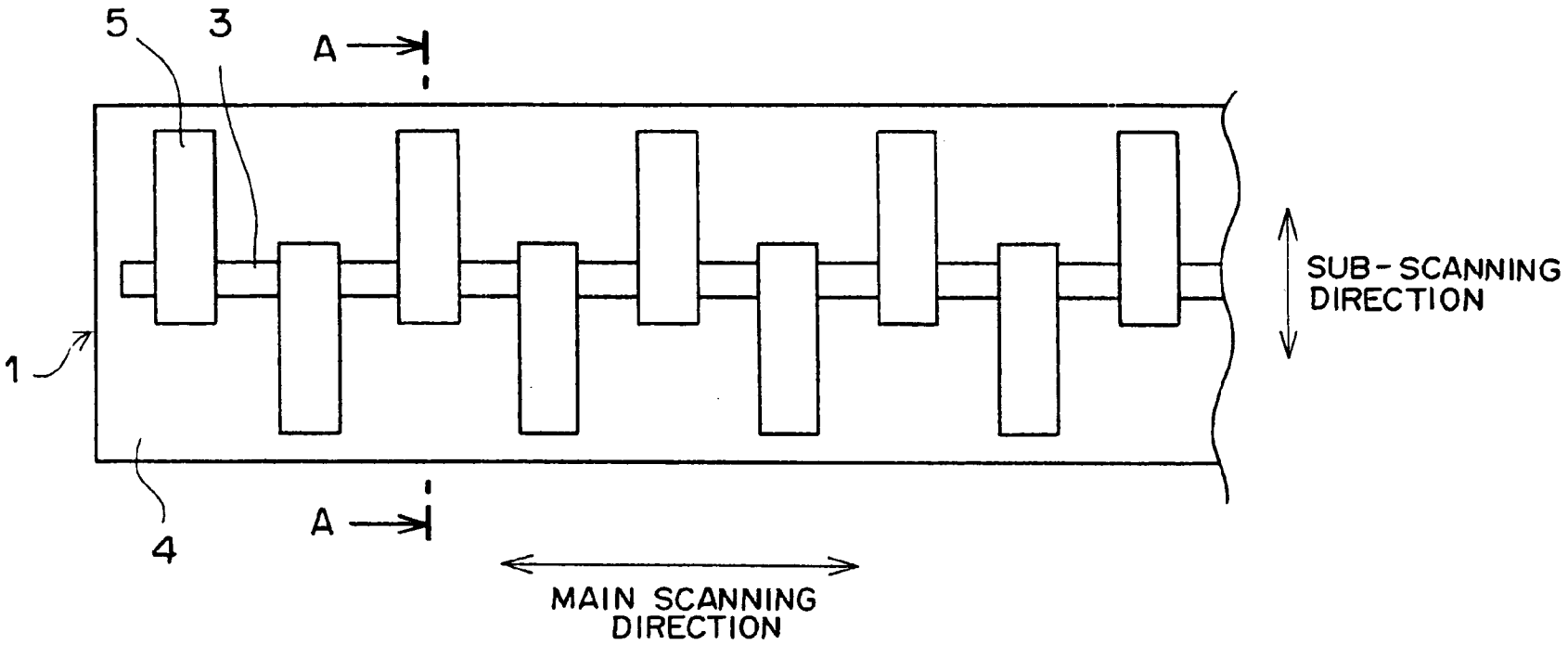
FIG. 2 is a fragmentary plan view of the thick film thermal head.

In FIGS. 1 to 3, a thick film thermal head in accordance with a first embodiment of the present invention comprises an electrically conductive substrate 1. A linear groove 2 is formed on the upper surface of the substrate 1 and a resistance heater strip 3 is embedded in the groove 2. An electrical insulating layer 4 is formed on the substrate 1 to cover substantially over the entire area thereof except that the resistance heater strip 3 is exposed through an opening 8. A plurality of discrete electrodes 5 are arranged in the longitudinal direction of the resistance heater strip 3 (in the main scanning direction) and are in contact with the heater strip 3 through the opening 8 at predetermined intervals. A protective layer 6 is formed to cover substantially the entire area of the insulating layer 4 including the discrete electrodes 5 and the heater strip 3.

It is preferred that the electrically conductive substrate 1 be also heat-conductive. That is, it is preferred that the substrate 1 be formed of a metal plate which is electrically conductive and heat-conductive, easy to process, and high in durability and resistance to corrosion. For example, the substrate 1 may be formed of aluminum alloy such as duralumin, copper alloy such as brass, or the like. These materials are generally inexpensive.

Figure 3A:
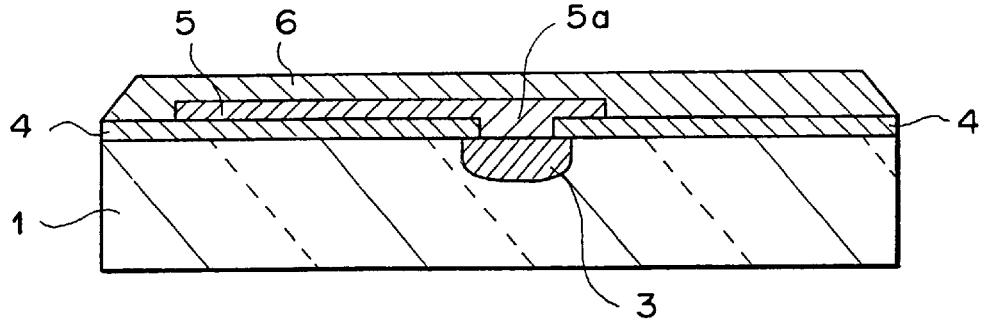
FIGS. 3A to 3C are cross-sectional views taken along line A—A in FIG. 2 showing variations of the cross-sectional shape of the groove.
Figure 3B:
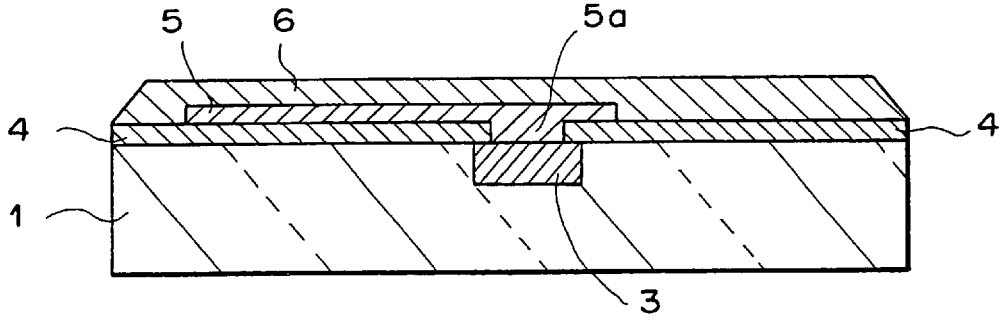
Figure 3C:
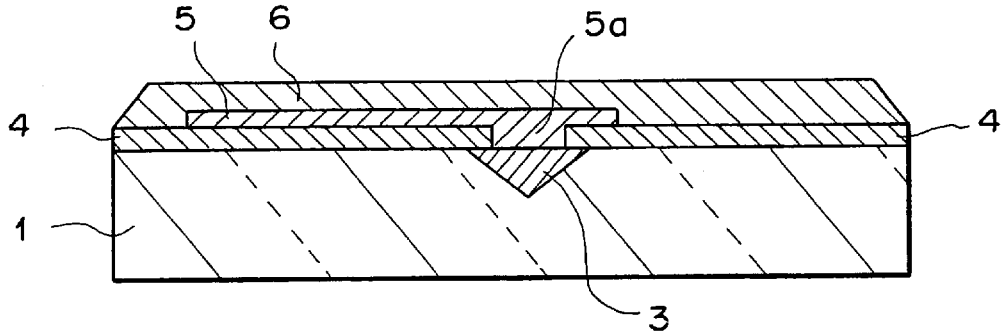

The linear groove 2 may be 15 to 60 $\mu$m (preferably 20 to 50 $\mu$m) in width and 30 to 80 $\mu$m in depth when resolution of printings is to be 400 dpi. The width of the linear groove 2 may be smaller so long as processing accuracy permits in order to realize higher resolution without limited to the values described above. The linear groove 2 may be, for instance, U-shaped, rectangular (trapezoidal) or V-shaped in cross-section as shown in FIGS. 3A to 3C. Since the resistance heater strip 3 is embedded in the groove 2, the width of the resistance heater strip 3 is governed by the width of the groove 2 and the cross-sectional shape of the resistance heater strip 3 is governed by the cross-sectional shape of the groove 2. Accordingly, the width of the groove 2 is determined according to a desired width (the length in the sub-scanning direction) of resistance heater elements 10 (to be described later), and the depth and the cross-sectional shape of the groove 2 is determined according to a desired heat capacity of each of the heater elements 10.

Though the depth and the width of the groove 2 need not be limited to those described above, when the groove 2 is too shallow, a practically necessary cross-sectional area of the resistance heater strip 3 cannot be obtained and when the groove 2 is too deep, it becomes difficult to form the groove 2.

The resistance heater strip 3 is formed by uniformly filling, for instance, paste of ruthenium oxide or carbon resister material in the linear groove 2 by a squeegee or the like and curing the paste. The resistance heater strip 3 is completely in the groove 2 and does not project above the upper surface of the substrate 1. The resistance heater strip 3 extends linearly along the groove 2 and conforms to the groove 2 in cross-sectional shape. It is preferred that the material of the resistance heater strip 3 be a material which can provide heat generating characteristics practical as resistance heater elements 10, can be uniformly filled in the groove 2 by a squeegee or the like, and is good in adhesion (wetting) or interfacial bonding strength to the substrate 1.

The opening 8 of the insulating layer 4 is smaller in width than the groove 2 and the discrete electrodes 5 are in contact with the resistance heater strip 3 only through the opening 8. At the same time, the discrete electrodes 5 are electrically insulated from the substrate 1 by the insulating layer 4 except through the resistance heater strip 3. Preferably the insulating layer 4 is of a material which is good in electrical insulation properties, is resistant to heat generated from the resistance heater elements 10, is able to be formed in film of uniform thickness and is good in adhesion to the substrate 1. More specifically, the material of the insulating layer 4 may be of a material which is resistant to a temperature of 120° C. to200° C. to which the heater elements 10 are heated, e.g., heat-resistant polyimide resin, heat-resistant epoxy resin, ceramic, anodized aluminum or the like. The insulating layer 4 may be formed integrally with the electrically conductive substrate 1, for instance, by anodizing the surface of a metal substrate 1 to a desired depth. In this case, the insulating layer 4 can be formed easily at low cost. When the insulating layer 4 is of heat-resistant resin, the insulating layer 4 may be formed by coating liquid resin on the surface of the substrate 1 and thermosetting or ultraviolet-curing the coating. Otherwise film of heat-resistant resin uniform in quality and thickness may be bonded on the surface of the substrate 1.

A part 5*a* of each discrete electrode 5 extends downward and is in contact with the resistance heater element 3, and when an electric voltage is applied between the discrete electrode 5 and the substrate 1, which functions as a common electrode, basically only the part of the resistance heater strip 3 between the downward extension 5*a* of the discrete electrode 5 and the substrate 1 generates heat. That is, the parts of the resistance heater strip 3 in contact with the downward extensions 5*a* of the discrete electrodes 5 form the resistance heater elements 10.

Accordingly, the length in the main scanning direction (the longitudinal direction of the resistance heater strip 3) of the downward extension 5*a* of the discrete electrode 5 determines the length in the main scanning direction of each resistance heater element 10 and the length in the sub-scanning direction of the downward extension 5*a* of the discrete electrode 5 determines the length in the sub-scanning direction of each resistance heater element 10. Since the downward extension 5*a* of the discrete electrode 5 is formed to fill the opening 8 in the sub-scanning direction, the width of the opening 8 substantially governs the length in the sub-scanning direction of each resistance heater element 10. Thus by limiting the width of the opening 8, the length in the sub-scanning direction of each resistance heater element 10 can be limited.

Figure 4:
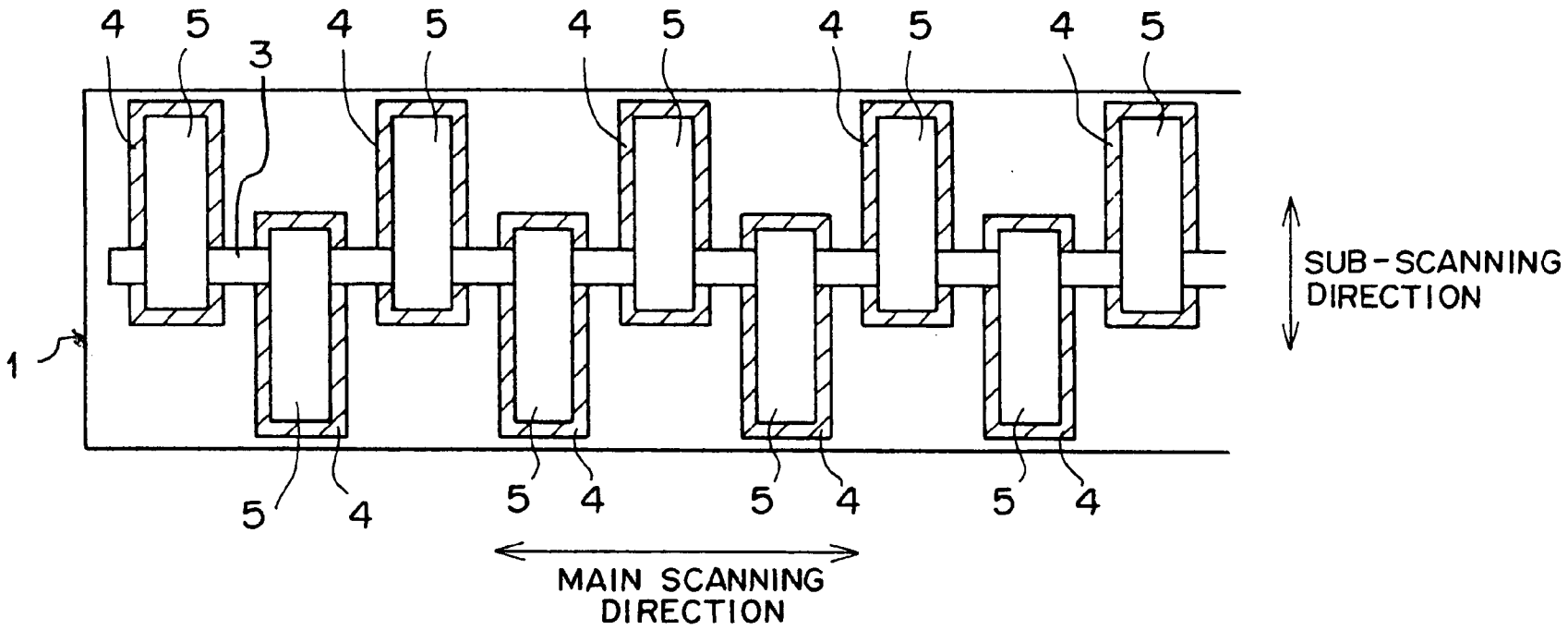
FIG. 4 is a fragmentary plan view showing a modification of the thermal head of the first embodiment.

The insulating layer 4 may be formed only below the discrete electrodes 5 as shown in FIG. 4 so long as the discrete electrodes 5 can be electrically insulated from the substrate 1. For example, an insulating layer is formed over the entire area of the substrate 1 and the parts not opposed to the discrete electrodes 5 may be then removed.

The discrete electrodes 5 are formed by, for instance, printing or photofabrication by the use of a material such as gold paste or electrically conductive aluminum paste which is good in electrical conductivity and easy to pattern, and are arranged in the longitudinal direction of the resistance heater strip 3 to be in contact with the resistance heater strip 3 through the opening 8 at predetermined pitches. For example, when the resolution is to be 400 dpi, the discrete electrodes 5 are arranged in the longitudinal direction of the resistance heater strip 3 to be in contact with the resistance heater strip 3 through the opening 8 at pitches of 63.5 $\mu$m. Further, as described above, the length in the main scanning direction (the longitudinal direction of the resistance heater strip 3) of each resistance heater element 10 is determined by the length in the main scanning direction of the downward extension 5*a* of the discrete electrode 5, or of the part at which the discrete electrode 5 is in contact with the resistance heater strip 3. Each of the discrete electrodes 5 is connected to the resistance heater element 3 at its one end (downward extension) and to a thermal head drive circuit at its the other end. In the conventional thick film thermal head, a plurality of discrete electrodes and common electrodes are arranged in the longitudinal direction of the resistance heater strip to be alternately in contact with the resistance heater strip and the parts of the resistance heater strip between pairs of adjacent discrete electrode and common electrode generate heat, i.e., form resistance heater elements. Accordingly, in the conventional thick film thermal head, a pair of electrodes are necessary to drive one resistance heater element. To the contrast, in the case of the thick film thermal head of this embodiment, since each resistance heater element 10 is formed between each discrete electrode 5 and the substrate 1 (which functions as a common electrode), only one electrode has to be formed on the surface of the thermal head for each resistance heater element 10. Accordingly, the number of electrodes to be formed on the surface of the thermal head can be substantially reduced to half. Further, in the conventional thick film thermal head, since two resistance heater elements on opposite sides of each discrete electrode are driven by an electric voltage applied to the discrete electrode, the electric voltage to be applied to each discrete electrode hag to be of lori a complicated waveform. To the contrast, in the thick film thermal head of this embodiment, since the electric voltage applied to one discrete electrode 5 exclusively drives one resistance heater element, the electric voltage applied to each discrete electrode 5 may be simple in waveform. Further crosstalk between adjacent resistance heater elements 10 can be prevented.

The protective layer 6 is formed to cover substantially the entire area of the insulating layer 4 including the discrete electrodes 5 and the heater strip 3 and protects the insulating layer 4, the discrete electrodes 5 and the heater strip 3 from wear, external impact, corrosion by atmospheric oxygen, and the like. The protective layer 6 may be of passivation film, which has been used, for instance, in a semiconductor device, or glass, which has been typically used in a thermal head. It is preferred that the protective layer 6 be as thin as possible so long as it can sufficiently protect the insulating layer 4, the discrete electrodes 5 and the heater strip 3.

Figure 5A:
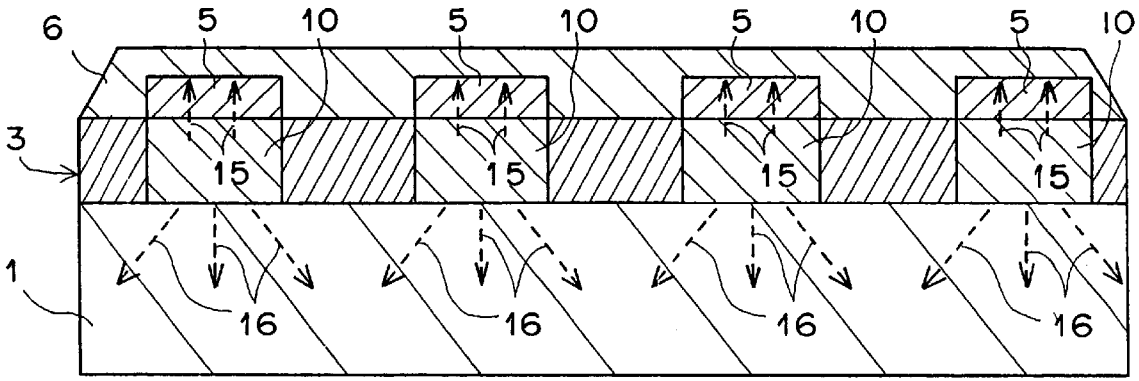
FIG. 5A is a schematic cross-sectional view showing propagation of heat generated by the resistance heater elements in the thermal head of the first embodiment.

Generation of heat and radiation of unnecessary heat in the thick film thermal head of this embodiment will be described with reference to FIGS. 5A and 5B, hereinbelow.

Figure 5B:
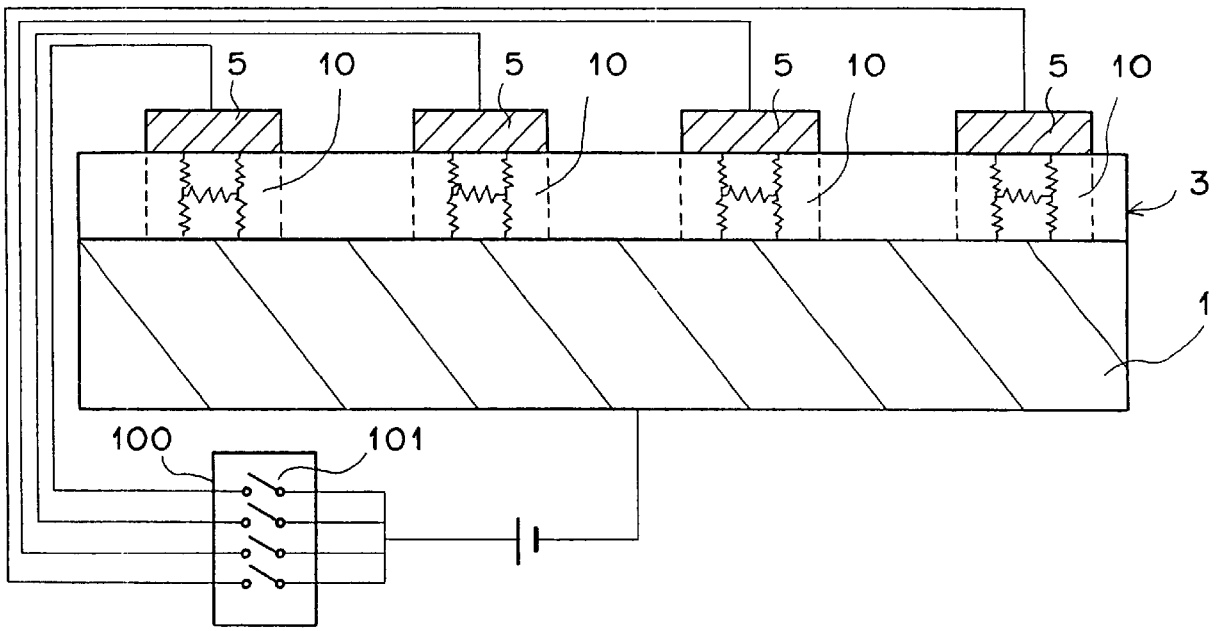
FIG. 5B is a schematic cross-sectional view showing electric drive circuit of the thermal head of the first embodiment.

As shown in FIG. 5B, the substrate 1 is connected to the negative pole of a power source and the discrete electrodes 5 are connected to the positive pole of the power source by way of a switching element array 101 built in a driver IC 100. When a drive voltage is applied to discrete electrodes 5, the parts of the resistance heater strip 3 between the discrete electrodes 5 and the substrate 1 (resistance heater elements 10) generate heat. A part of the generated heat propagates through the discrete electrodes 5, which are thin and good in heat conductivity, as shown by arrow 15 and reaches the surface of the protective layer 6 at which the thermal head is brought into contact with a recording medium (a heat-sensitive stencil material or a thermal recording paper). Since the electrodes 5 are in contact with the surface of the resistance heater strip 3 nearer to the surface at which the thermal head is brought into contact with a recording medium (this surface will be referred to as "the working surface", hereinbelow), heat generated by the resistance heater elements 10 reaches the working surface before propagating over a large distance and spreading wide. Accordingly, the effective heat generating area of each resistance heater element 10 is not so enlarged as compared with the conventional thick film thermal head where the resistance heater strip is in contact with the electrodes at the surface remote from the working surface and heat is generated from the surface of the resistance heater strip remote from the working surface. Thus when the thick film thermal head of this embodiment is employed in perforating a stencil material for making a stencil, perforations can be formed finely without fear of generating connected perforations, and when the thick film thermal head of this embodiment is employed in thermal recording or ribbon transfer printing, finer printing dots can be formed at a higher density.

Another part of the generated heat is transferred through the substrate 1 which is good in heat conductivity and radiated outside the thermal head from the bottom surface of the substrate 1 as shown by arrows 16. At this time, since the resistance heater strip 3 is embedded in the groove 2 formed in the substrate 1, the heater strip 3 is in a close contact with the substrate 1 and the heat can be quickly transferred to the substrate 1, whereby radiation of the heat is further promoted. Thus, in the thick film thermal head of this embodiment, the heat generation/heat radiation cycle of each resistance heater element 10 can be greatly shortened as compared with the conventional thick film thermal head, whereby unnecessary accumulation of heat can be avoided and temperature response of the resistance heater elements 10 can be improved. As a result, the thermal head can be operated at a higher speed.

Figure 6:
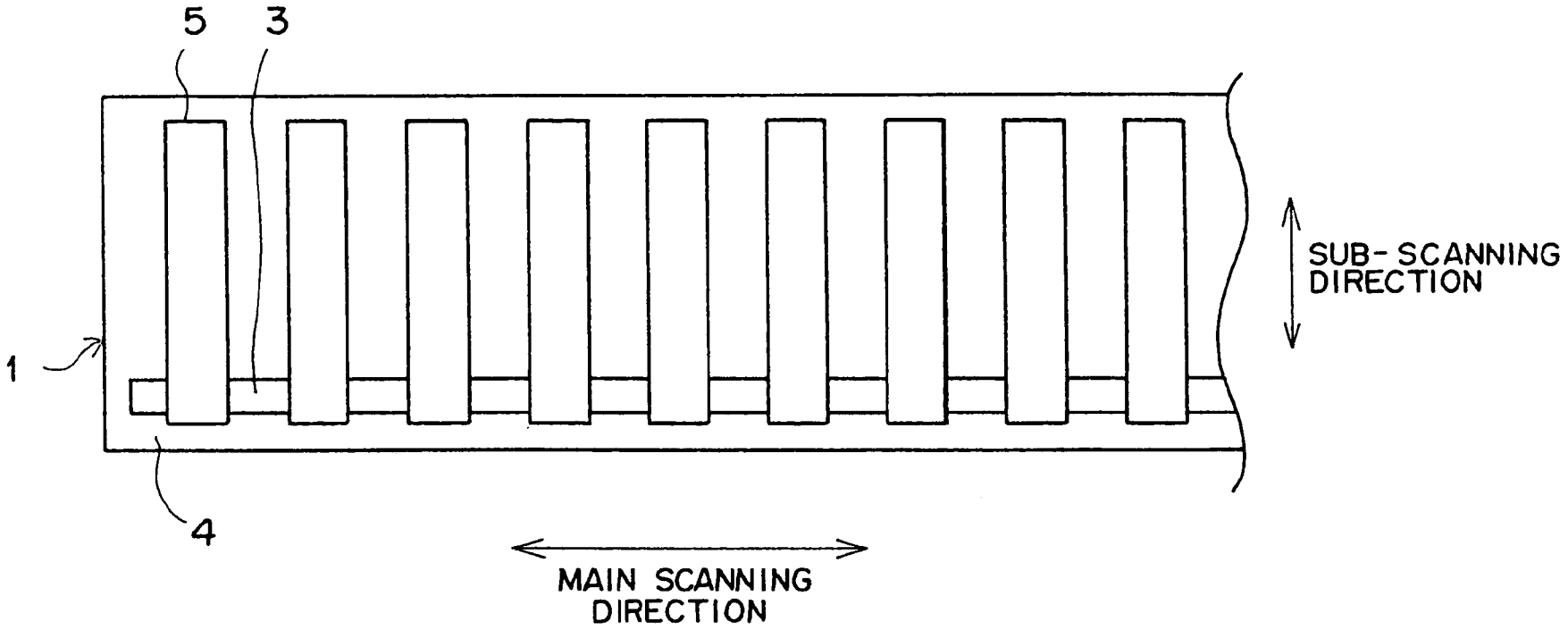
FIG. 6 is a plan view showing a modification of the first embodiment.

In the first embodiment described above, the discrete electrodes 5 alternately extend in opposite directions from the resistance heater strip 3 with the resistance heater strip 3 disposed near the middle between the side edges of the thermal head as clearly shown in FIG. 2. This arrangement of the discrete electrodes 5 is advantageous in that the space between the electrodes 5 on each side of the thermal head can be wider and accordingly, wiring is facilitated. However since the resistance heater strip 3 must be disposed near the middle between the side edges of the thermal head, the pattern of the discrete electrodes 5 shown in FIG. 2 cannot be applied to an edge type thermal head where the resistance heater elements are disposed near one edge of the thermal head. In the case of such an edge type thermal head, the resistance heater strip I may be disposed near one edge of the substrate 1 and the discrete electrodes 5 may be formed to extend all in the same direction from the resistance heater strip 3 as shown in FIG. 6.

An example of manufacturing process of the thermal head of the first embodiment will be described with reference to FIGS. 7A to 7I and 8A to 8I, hereinbelow. FIGS. 7A to 7I are cross-sectional views for illustrating in sequence different stages of manufacturing process of the thermal head of the first embodiment, and FIGS. 8A to 8I are perspective views respectively corresponding to FIGS. 7A to 7I.

Figure 7A:
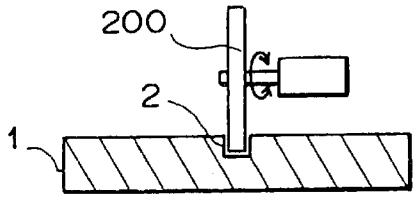
FIGS. 7A to 7I and 8A to 8I are views for illustrating in sequence different stages of an example of manufacturing process of the thermal head of the first embodiment.
Figure 8A:
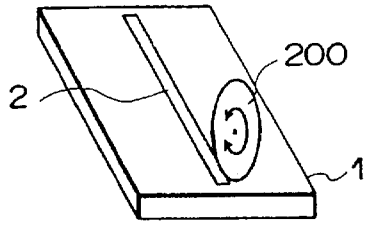

An electrically conductive substrate 1 such as of aluminum alloy is first prepared and a linear groove 2 is formed on the surface of the substrate 1 in a predetermined depth as shown in FIGS. 7A and 8A. The linear groove 2 is formed by the use of, for instance, a rotary stone 200 such as a dicing saw for dicing a semiconductor substrate or the like, or a wire saw which cuts a workpiece while supplying diamond slurry to the part to be cut. Further, the groove 2 may be formed by the use of an industrial laser or may be chemically formed by etching. The groove 2 may be formed when pressing the substrate 1. It is preferred that a method which can easily form a desired fine groove 2 at a high accuracy at low cost be employed. As the rotary stone 200, a super-thin rotary diamond cutter (e.g, a rotary blade in NBC-Z series from Disco Corporation) may be suitably used. With such a rotary stone, a groove 2 as fine as several $\mu$m to several tens $\mu$m can be accurately cut. The grit of the rotary stone may be, for instance, in the range of #320-grit to #450-grit.

Figure 7B:
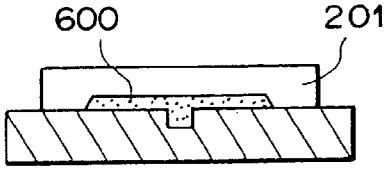
Figure 8B:
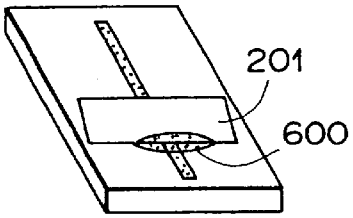
Figure 7C:
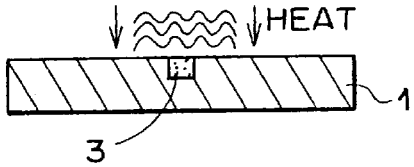
Figure 8C:
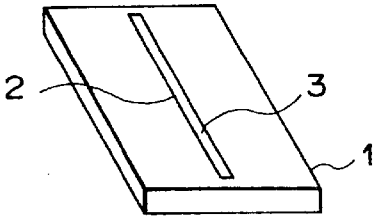

Then paste 600 for forming the resistance heater strip 3 such as ruthenium oxide paste is filled in the linear groove 2 by a squeegee 201 as shown in FIGS. 7B and 8B. Then the paste 600 is heat-treated and cured, thereby forming a solid resistance heater strip 3 as shown in FIGS. 7C and 8C.

Figure 7D:
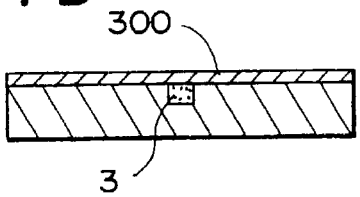
Figure 8D:
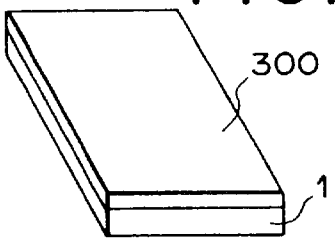
Figure 7E:
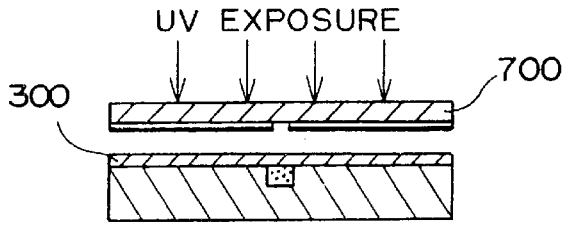
Figure 8E:
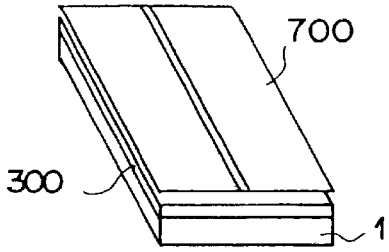
Figure 7F:
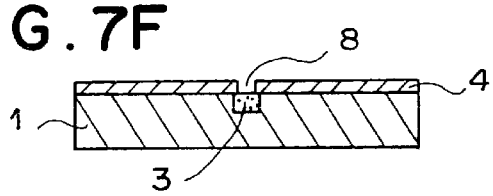
Figure 8F:
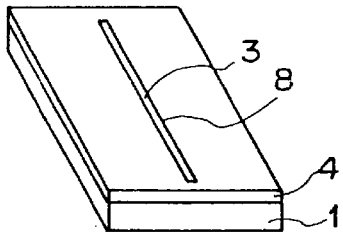

A film 300 of a material for forming an insulating layer 4 which is photosensitive and has properties required to the insulating layer 4, (e., heat resistance) such as ultraviolet-curing epoxy resin or photosensitive polyimide obtained by introducing acryloyl into polyimide, is formed to cover the entire area of the surface of the substrate 1 including the upper surface of the resistance heater strip 3 as shown in FIGS. 7D and 8D. The film 300 may be formed by coating the material or bonding film of the material in uniform thickness. Then the film 300 is exposed to ultraviolet rays through a mask 700 to form a latent image on the film 300 as shown in FIGS. 7E and 8E, and then the latent image is developed, thereby forming an insulating layer 4 provided with an opening 8 which exposes the upper surface of the resistance heater strip 3 over a predetermined length and width as shown in FIGS. 7F and 8F.

Figure 7G:
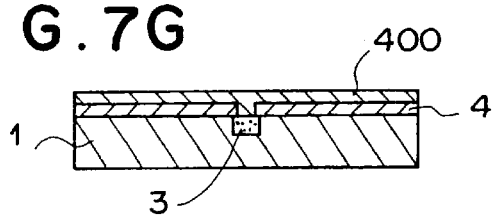
Figure 8G:
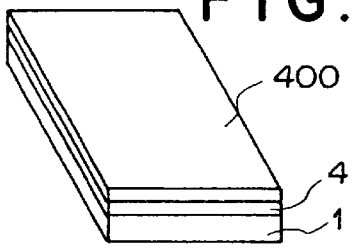
Figure 7H:
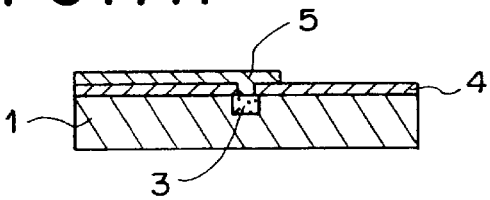
Figure 8H:
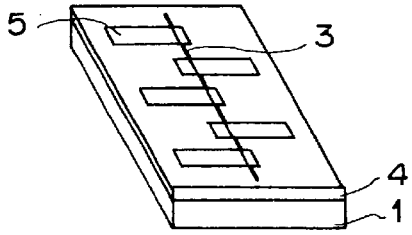

Thereafter electrically conductive film 400 of paste of gold, silver or the like for forming the discrete electrodes 5 is formed over the entire upper surface of the insulating layer 4 including the opening 8 and the film 400 is cured as shown in FIGS. 7G and 8G. Then discrete electrodes 5 are formed by patterning the film 400 by, for instance, photolithography as shown in FIGS. 7H and 8H.

Figure 7I:
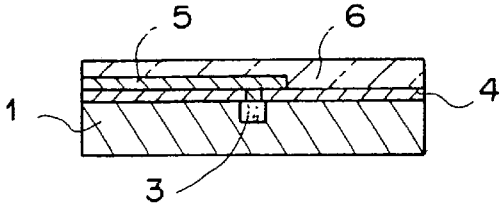
Figure 8I:
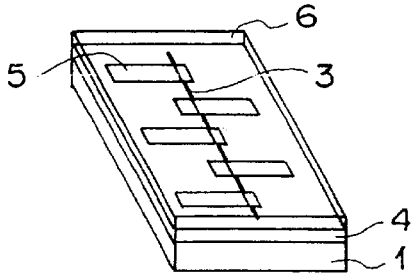

Thereafter, a protective layer 6 is formed to cover the discrete electrodes 5, the insulating layer 4 and the like as shown in FIGS. 7I and 8I, thereby obtaining a thick film thermal head.

In accordance with the first embodiment described above, since the aluminum alloy plate or the like employed as the substrate 1 is easy to shape and easy to cut a groove 2 therein and is inexpensive, the manufacturing cost of the thick film thermal head can be reduced. Further, when a large size thick film thermal head is made by the use of a substrate of ceramic as in the conventional thick film thermal head, it is difficult to make flat the ceramic substrate due to repeated heat treatments required to form a ceramic plate. To the contrast, in accordance with the first embodiment of the present invention, use of an aluminum alloy plate or the like as the substrate 1 permits to easily obtain flatness of the substrate since an aluminum alloy plate or the like can be processed by cold processing such as cutting or etching.

Second Embodiment

A thick film thermal head in accordance with a second embodiment of the present invention will be described, hereinbelow. The thick film thermal head of the second embodiment mainly differs from that of the first embodiment in that the opening 8 in the insulating layer 4 is completely aligned with the groove 2 in the substrate 1 and completely conforms to the groove 2 in two-dimensional shape.

That is, in the second embodiment, after an insulating film is formed on the surface of the substrate 1, the linear groove 2 is cut in the substrate 1 through the insulating film so that the opening 8 in the insulating layer 4 and the groove 2 in the substrate 1 are formed at one time with the opening 8 and the groove 2 automatically aligned with each other whereby, yield of the thermal head can be further increased and the process of forming the groove 2 and the opening 8 is further facilitated. As a result, a thick film thermal head equivalent to that of the first embodiment in performance can be manufactured more easily at lower cost.

An example of manufacturing process of the thermal head of the second embodiment will be described with reference to FIGS. 9A to 9G and 10A to 10G, hereinbelow. FIGS. 9A to 9G are cross-sectional views for illustrating in sequence different stages of manufacturing process of the thermal head of the second embodiment, and FIGS. 10A to 10C are perspective views respectively corresponding to FIGS. 9A to 9G.

Figure 9A:
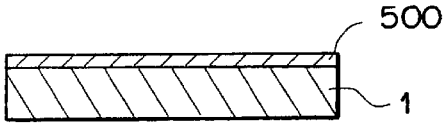
FIGS. 9A to 9G and 10A are views for illustrating in sequence different stages of an example of manufacturing process of a thick film thermal head in accordance with a second embodiment of the present invention.
Figure 10A:
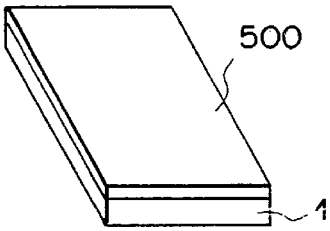

An electrically conductive substrate 1 such as of aluminum alloy is first prepared and a film 500 of a material for forming an insulating layer 4 which has properties required to the insulating layer 4, (e.g., heat resistance) such as heat-sensitive polyimide resin or heat-sensitive epoxy resin, is formed to cover the entire area of the surface of the substrate 1 as shown in FIGS. 9A and 10A. The film 500 may be formed by bonding film of the material in uniform thickness.

Figure 9B:
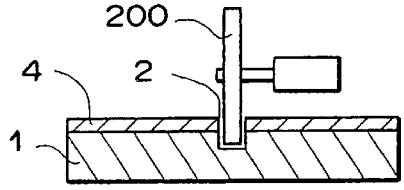
Figure 10B:
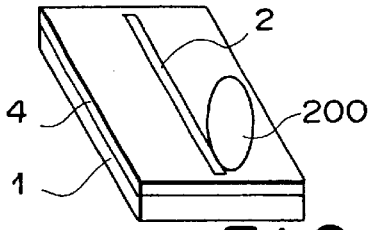
Figure 9C:
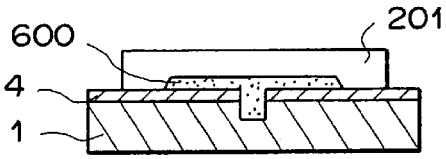
Figure 10C:
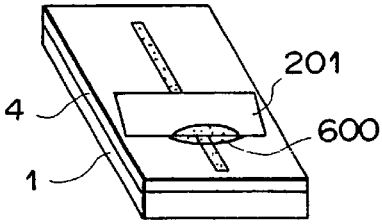
Figure 9D:
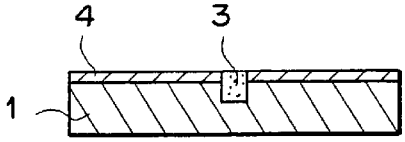
Figure 10D:
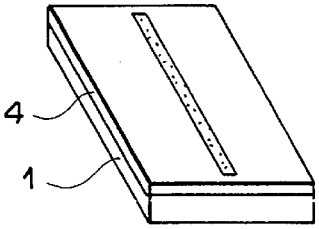

Then a linear groove 2 is formed on the surface of the substrate 1 in a predetermined depth through the insulating layer 4 as shown in FIGS. 9B and 10B. The linear groove 2 is formed by the use of, for instance, a rotary stone 200 such as a dicing saw. Then paste 400 for forming the resistance heater strip 3 such as ruthenium oxide paste is filled in the linear groove 2 by a squeegee 201 as shown in FIGS. 9C and 10C. Then the paste 600 is heat-treated and cured, thereby forming a solid resistance heater strip 3 as shown in FIGS. 9D and 10D.

Figure 9E:
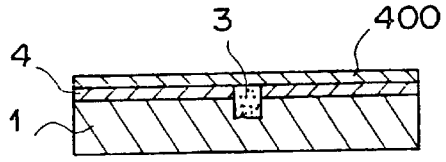
Figure 10E:
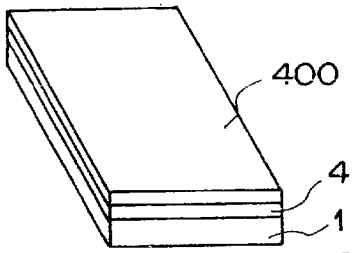

Thereafter electrically conductive film 400 of paste of gold, silver or the like for forming the discrete electrodes 5 is formed over the entire upper surface of the insulating layer 4 including the upper surface of the resistance heater strip 3 and the film 400 is cured as shown in FIGS. 9E and 10E.

Figure 9F:
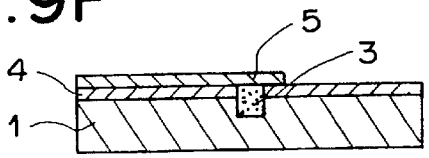
Figure 10F:
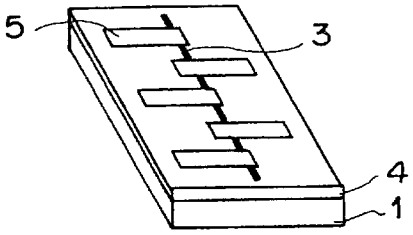

Then discrete electrodes 5 are formed by patterning the film 400 by, for instance, photolithography as shown in FIGS. 9F and 10F.

Figure 9G:
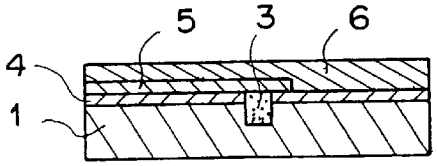
Figure 10G:
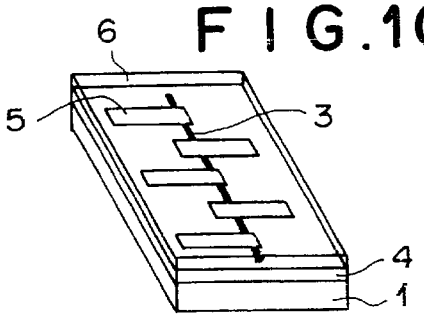

Thereafter, a protective layer 6 is formed to cover the discrete electrodes 5, the insulating layer 4 and the like as shown in FIGS. 9G and 10G, thereby obtaining a thick film thermal head.

In accordance with the second embodiment described above, since the opening 8 of the insulating layer 4 and the groove 2 of the substrate 1 can be formed in one step and are automatically aligned with each other, the step of forming the opening 8 by photolithography or the like can be omitted and accordingly, the manufacturing process of the thick film thermal head can be further facilitated, whereby yield of the thermal head can be further improved and the manufacturing cost can be further reduced.

Third Embodiment

Figure 11:
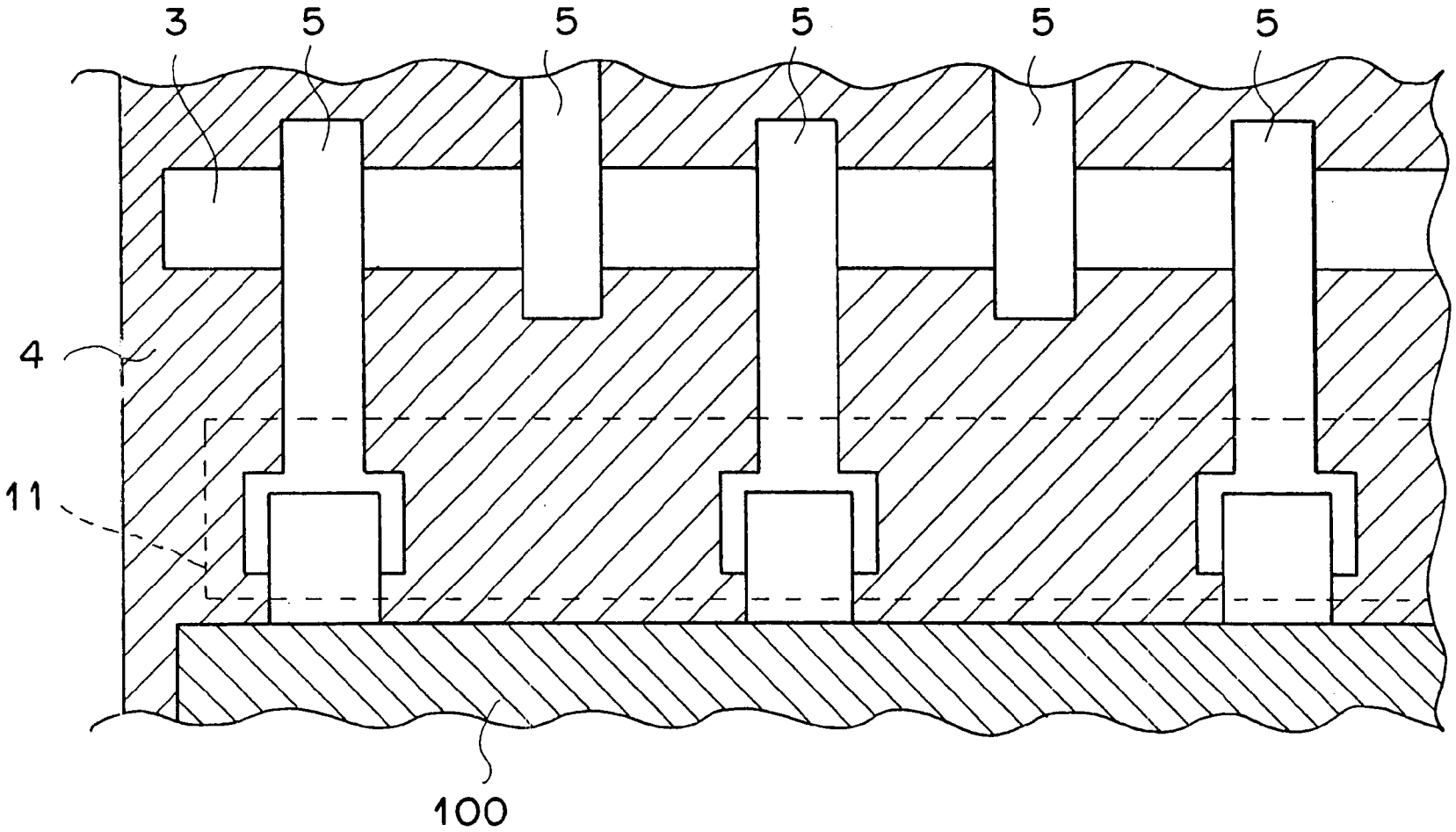
FIG. 11 is a fragmentary plan view showing a thick film thermal head in accordance with a third embodiment of the present invention.

As shown in FIG. 11, a thick film thermal head in accordance with a third embodiment of the present invention differs from the first and second embodiments in that the insulating layer 4 is formed of heat-resistant epoxy resin, heat-resistant polyimide resin or the like employed for forming a printed circuit board and a circuit pattern 11 and a driver IC 100 are formed on the surface of the insulating layer 4 together with the discrete electrodes 5.

That is, by providing a drive system including the driver IC 100 and the circuit pattern 11 for driving the discrete electrodes 5 on the surface of the insulating layer 4, the thermal head can be provided with a drive system on its body, whereby a printed circuit board and a ceramic hybrid substrate for the drive system which are conventionally formed separately from the thick film thermal head body can be eliminated. As a result, the number of components of the thermal head can be reduced and the overall manufacturing cost of the thermal head can be further reduced.

Other Embodiments

Figure 12A:
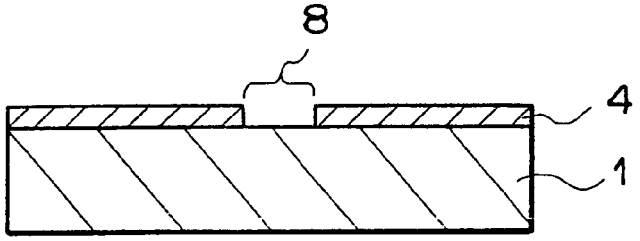
FIGS. 12A to 12C are views for illustrating in sequence different stages of an example of manufacturing process of a thick film thermal head in accordance with a fourth embodiment of the present invention.
Figure 12B:
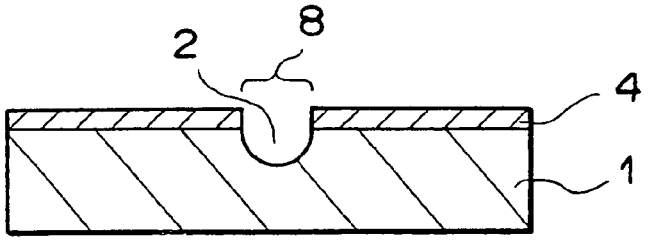
Figure 12C:
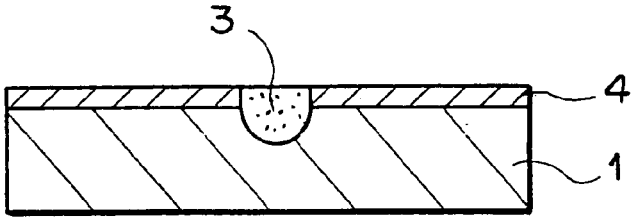

When the substrate 1 is able to be etched, the groove 2 may be formed by etching the substrate 1 with the insulating layer 4 used as a resist as shown in FIGS. 12A to 12C. That is an insulating layer 4 is formed over substantially the entire area of the surface of an electrically conductive substrate 1 and an opening 8 is formed in the insulating layer 4 in a predetermined shape and predetermined dimensions as shown in FIG. 12A. Then the part of the substrate 1 exposed through the opening 8 is etched, thereby forming a groove 2 on the surface of the substrate 1 as shown in FIG. 12B. Thereafter, paste for forming a resistance heater strip 3 is filled in the groove 2 as shown in FIG. 12C. the groove 2 is formed by etching the substrate 1 by the use of a photoresist separately from the insulating layer 4.

Though, in the embodiments described above, the substrate 1 is entirely formed of an electrically conductive material, the substrate 1 need not be entirely electrically conductive so long as it has an electrically conductive portion which can function as a common electrode.

Figure 13A:
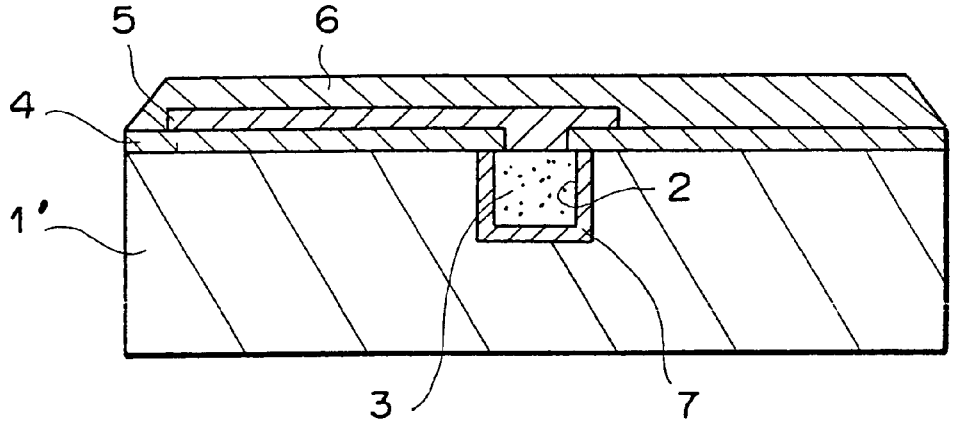
FIGS. 13A to 13C are schematic cross-sectional views respectively showing fourth to sixth embodiments of the present invention.

For example, in a thermal head in accordance with a fourth embodiment of the present invention shown in FIG. 13A, the substrate 1' is basically formed of electrical insulating material and is provided with an electrically conductive layer 7 along the side surfaces and the bottom surface of the groove 2. The electrically conductive layer 7 may be formed by, for instance, plating or deposition In this case, the electrically conductive layer 7 functions as a common electrode.

Figure 13B:
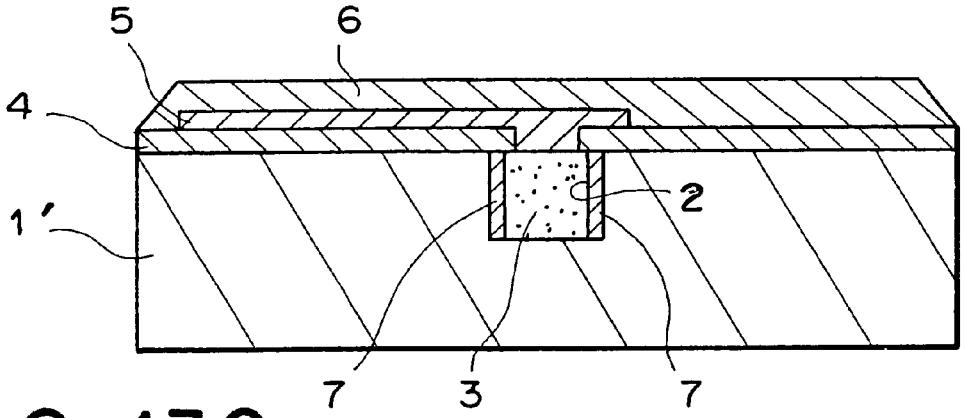

In a thermal head in accordance with a fifth embodiment of the present invention shown in FIG. 13B the substrate 1' is basically formed of electrical insulating material and is provided with an electrically conductive layer 7 along the side surfaces of the groove 2. Also in this case, the electrically conductive layer 7 functions as a common electrode.

Figure 13C:
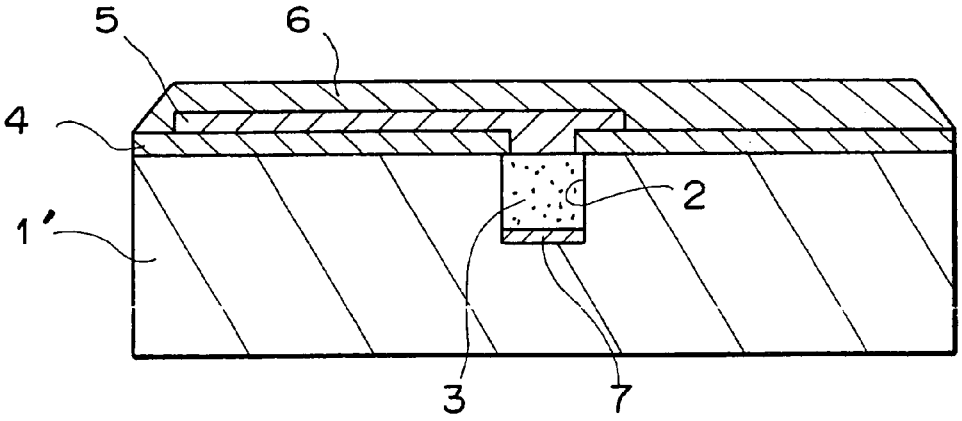

In a thermal head in accordance with a sixth embodiment of the present invention shown in FIG. 13C, the substrate 1' is basically formed of electrical insulating material and is provided with an electrically conductive layer 7 along the bottom surface of the groove 2. Also in this case, the electrically conductive layer 7 functions as a common electrode.

Figure 14A:
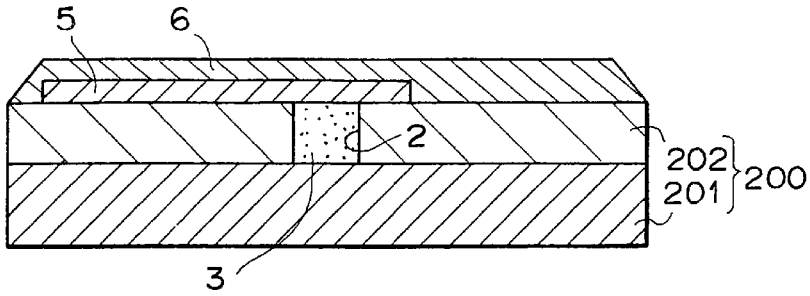
FIGS. 14A to 14D are schematic cross-sectional views respectively showing seventh to tenth embodiments of the present invention.

In a thermal head in accordance with a seventh embodiment of the present invention shown in FIG. 14A, the thermal head is provided with a substrate 200 comprising an electrically conductive plate 201 having a flat upper surface and an electrical insulating layer 202 superposed on the flat upper surface of the electrically conductive plate 201 and the grove 2 is formed through the electrical insulating layer 202 so that the bottom of the groove 2 is formed by the electrically conductive plate 201 so that the resistance heater strip 3 embedded in the groove 2 contacts with the electrically conductive plate 201. In this case, the electrically conductive plate 201 functions as a common electrode. The electrical insulating layer 202 may be provided by forming an electrical insulating film on the surface of the electrically conductive plate 201 or by bonding a plate of an electrical insulating material to the surface of the electrically conductive plate 201.

Figure 14B:
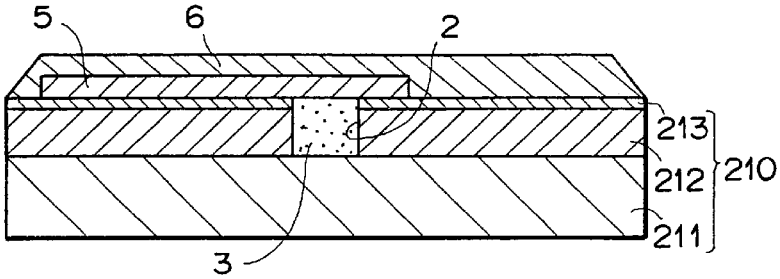

In a thermal head in accordance with an eighth embodiment of the present invention shown in FIG. 14B, the thermal head is provided with a substrate 210 comprising an electrical insulating plate 211 having a flat upper surface, an electrically conductive plate 212 superposed on the flat upper surface of the electrical insulating plate 211 and an electrical insulating layer 213 superposed on the electrically conductive plate 212 and the grove 2 is formed through the electrical insulating layer 213 so that the bottom of the groove 2 is formed by the electrical insulating plate 211 and the resistance heater strip 3 embedded in the groove 2 contacts with the electrically conductive plate 212. In this case, the electrically conductive plate 212 functions as a common electrode.

Figure 14C:
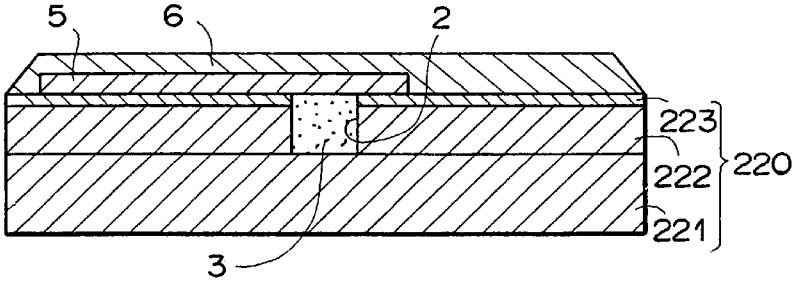

In a thermal head in accordance with a ninth embodiment of the present invention shown in FIG. 14C, the thermal head is provided with a substrate 220 comprising a first electrically conductive plate 221 having a flat upper surface, a second electrically conductive plate 222 superposed on the flat upper surface of the first electrically conductive plate 221 and an electrical insulating layer 223 superposed on the second electrically conductive plate 222 and the grove 2 is formed through the electrical insulating layer 223 and the second electrically conductive plate 222 so that the bottom of the groove 2 is formed by the first electrically conductive plate 221 and the resistance heater strip 3 embedded in the groove 2 contacts with the first electrically conductive plate 221. In this case, the first and second electrically conductive plates 221 and 222 function as a common electrode. The second electrically conductive plate 222 may be formed of a pair of electrically conductive plates which are bonded to the surface of the first electrically conductive plate 221 with a gap between. The gap between the electrically conductive plates forms the groove 2.

Figure 14D:
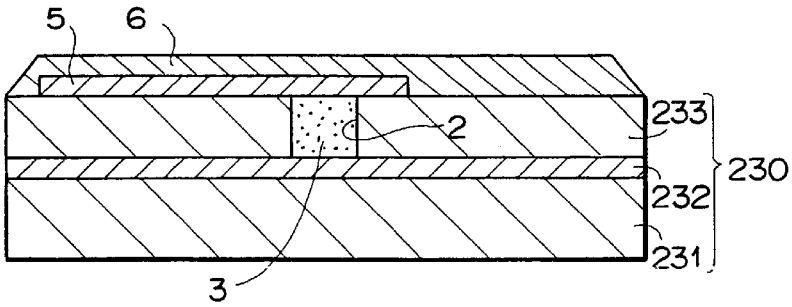

In a thermal head in accordance with tenth embodiment of the present invention shown in FIG. 14D, the thermal head is provided with a substrate 230 comprising a first electrical insulating plate 231 having a flat upper surface, an electrically conductive layer 232 superposed on the flat upper surface of the first electrical insulating plate 231 and a second electrical insulating plate 233 superposed on the electrically conductive layer 232 and the grove 2 is formed through the second electrical insulating plate 233 so that the bottom of the groove 2 is formed by the electrically Conductive layer 232 and the resistance heater strip 3 embedded in the groove 2 contacts with the electrically conductive layer 232. In this case, the electrically conductive layer 232 functions as a common electrode.

Figure 14E:
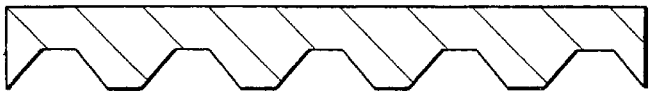
FIG. 14E is a schematic cross-sectional view showing a modification of the seventh to tenth embodiments.
Figure 15:
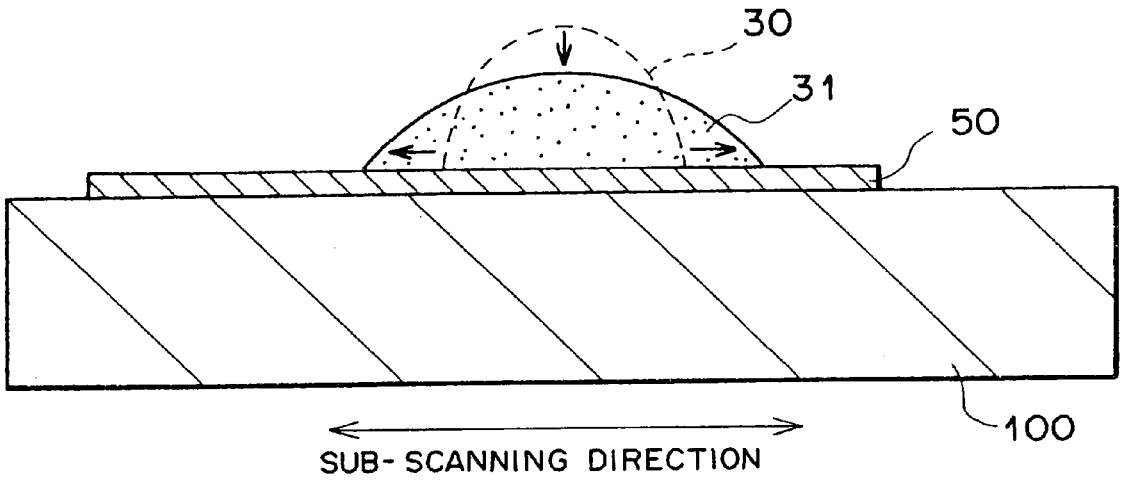
FIG. 15 PRIOR ART
FIG. 15 is a cross-sectional view showing formation of the resistance heater strip in a conventional thick film thermal head.

In the seventh to tenth embodiments, by forming recesses on the bottom surface of the lowermost layer as shown in FIG. 14E and increasing the contact area to the atmosphere, heat radiating effect of the substrate can be enhanced and even if an electrical insulating substrate which is poor in heat conductivity is used, unnecessary heat can be well radiated.

In addition, all of the contents of Japanese Patent Application No. 11(1999)-245841 are incorporated into this specification by reference.

What is claimed is:

1. A thick film thermal had comprising;

a substrate which is provided with a groove on a surface thereof to extend in a main scanning direction and has an electrically conductive portion which faces the groove and extends substantially over the entire length of the groove, a resistance heater strip embedded in the groove to be in contact with the electrically conductive portion substantially over the entire length thereof, a plurality of discrete electrodes which are formed on the substrate and are in contact with the resistance heater strip at predetermined intervals in the main scanning direction, and an electrical insulating layer disposed between the substrate and the plurality of discrete electrodes except where the electrodes are in contact with the resistance heater strip, wherein the discrete electrodes are electrically insulated from the electrically conductive portion of the substrate except through the resistance heater strip, and the electrically conductive portion is connected to a power source to be applied with an electrical potential and forms a common electrode with the discrete electrodes being connected to the power source through respective switching means to be selectively supplied with an electrical potential different from that applied to the electrically conductive portion.

2. A thick film thermal head as defined in claim 1 in which an electrical insulating layer is provided between the discrete electrodes and the substrate, the electrical insulating layer being provided with an opening in alignment with said groove in the substrate and the discrete electrodes being in contact with the resistance heater strip through the opening in the insulating layer.

3. A thick film thermal head as defined in claim 2 in which the opening in the insulating layer is narrower than the groove in the substrate in width.

4. A thick film thermal head as defined in claim 1 in which the substrate comprises an electrically conductive layer and an electrical insulating layer superposed on the electrically conductive layer, and the groove is formed through the electrical insulating layer up to the electrically conductive layer, the electrically conductive layer forming said common electrode.

5. A thick film thermal head as defined in claim 1 in which the substrate comprises a first electrical insulating layer, an electrically conductive layer and a second electrical insulating layer superposed one on another in this order, and the groove is formed through the second electrical insulating layer and the electrically conductive layer up to the first electrical insulating layer, the electrically conductive layer forming said common electrode.

6. A thick film thermal head as defined in claim 1 in which the substrate is heat-conductive.

7. A thick film thermal head as defined in claim 1 in which a circuit pattern including the discrete electrodes is formed on the surface of the substrate electrically insulated from the electrically conductive portion of the substrate.

8. A method of manufacturing a thick film thermal head defined in claim 1 comprising the steps forming a groove on a surface of an electrically conductive substrate to extend in a main scanning direction, embedding a resistance heater strip in the groove, forming an electrical insulating layer on the surface of the substrate with the resistance heater strip exposed through an opening, and forming a plurality of discrete electrodes on the electrical insulating layer to be in contact with the resistance heater strip in the groove through the opening in the electrical insulating layer at predetermined intervals in the main scanning direction.

9. A method of manufacturing a thick film thermal head as defined in claim 8 in which the opening in the electrical insulating layer is formed to be narrower than the groove in width.

10. A method of manufacturing a thick film thermal head as defined in claim 8 in which the electrical insulating layer is formed by bonding electrical insulating film on the surface of the substrate.

11. A method of manufacturing a thick film thermal head as defined in claim 8 further comprising a step of forming a circuit pattern including the discrete electrodes on the surface of the electrical insulating layer.

12. A method of manufacturing a thick film thermal head defined in claim 1 comprising the steps of forming an electrical insulating layer on an electrically conductive substrate, forming a groove through the electrical insulating layer to a predetermined depth in the substrate to extend in a main scanning direction, embedding a resistance heater strip in the groove, and forming a plurality of discrete electrodes on the electrical insulating layer to be in contact with the resistance heater strip in the groove at predetermined intervals in the main scanning direction.

13. A method of manufacturing a thick film thermal head as defined in claim 12 in which the electrical insulating layer is formed by bonding electrical insulating film on the surface of the substrate.

14. A method of manufacturing a thick film thermal head as defined in claim 12 further comprising a step of forming a circuit pattern including the discrete electrodes on the surface of the electrical insulating layer.

* * * * *